US005715545A

United States Patent [19]

Forwick

[11] Patent Number: 5,715,545

[45] Date of Patent: Feb. 10, 1998

[54] BATHING AID

[76] Inventor: Robert Forwick, Balanstrasse 39, 81669 München, Germany

[21] Appl. No.: 690,071

[22] Filed: Jul. 31, 1996

Related U.S. Application Data

[63] Continuation-in-part of Ser. No. 234,243, Apr. 28, 1994, abandoned.

[30] Foreign Application Priority Data

Apr. 28, 1993 [DE] Germany ..... 43 13 986.8

[51] Int. Cl.[6] ..... A47K 3/02

[52] U.S. Cl. ..... 4/563.1

[58] Field of Search ..... 4/560.1–566.1

[56] References Cited

U.S. PATENT DOCUMENTS 2,813,277 11/1957 Zillt .
3,879,770 4/1975 Grant .
3,918,108 11/1975 Feyerherm .
5,129,112 7/1992 Schaffer .
5,218,727 6/1993 Krumbeck .

FOREIGN PATENT DOCUMENTS 2206007 1/1980 Germany ..... 4/560.1
2197636 5/1988 United Kingdom ..... 4/561.1

*Primary Examiner*—Charles E. Phillips
*Attorney, Agent, or Firm*—Bradford E. Kile

[57] ABSTRACT

A bathing aid, i.e. a bathtub lift, includes a column of telescoping hydraulic cylinders fixedly mounted on a floor laterally next to a head of a bathtub. The telescoping hydraulic cylinders are actuatable solely by tap water pressure so as to be telescopically moved within one another. The hydraulic cylinders include an uppermost hydraulic cylinder with a head. A crossbar is secured with low friction to the head of the uppermost hydraulic cylinder, is swivelable through at least 90° and has a free end. A seat has a backrest being pivotably connected to the free end of the crossbar, for lowering and raising the seat telescopingly and swiveling the seat out of the bathtub.

9 Claims, 3 Drawing Sheets

BATHING AID

CROSS-REFERENCE TO RELATED APPLICATION

This is a continuation-in-part of my application Ser. No. 08/234,243, filed Apr. 28, 1994, now abandoned.

BACKGROUND OF THE INVENTION

1. Field of the Invention

The invention relates to a bathing aid with a seat that can be lowered and raised in telescoping fashion and swiveled out of the bathtub.

A bathing aid is known in principle from Published European Application No. 0 380 621 A, in which a seat that is secured to a frame which is insertable into a bathtub and has upwardly-protruding hydraulic cylinders that are inclined toward the rear, can be raised and lowered hydraulically.

Such a seat makes taking a bath considerably easier for handicapped persons, especially since the seat can be lowered as far as the bottom of the bathtub. However, in the case of severely handicapped persons, especially those who are paralyzed with transverse lesions of the spinal cord, it is impossible to reach the seat from a wheelchair wheeled next to the bathtub, without external assistance.

U.S. Pat. No. 3,879,770 to Grant discloses a bathing aid with a base cylinder and an outer support cylinder, which slides about the outer periphery of the base cylinder. A piston is received in the base cylinder which is actuated by tap water pressure. A seat is attached via an arm at the outer support cylinder. The seat is swivellable. The swivel action is achieved by swivelling the support cylinder about the stationary base cylinder. With the limited amount of telescope length, it is impossible with that structure to reach a sufficiently satisfactory lifting height. Furthermore, since the outer support cylinder is rotatable relative to the base cylinder, the result is a relatively complicated structure because it is necessary to seal the rotatable structure relative to the water pressure.

German reference DE 22 06 007 to Meyer, Jr., discloses a bathing aid with a seat which can be lifted by means of a spindle. That prior art bathing aid has a saddle frame which is attached at the long side of the tub. The saddle frame includes a column in which the spindle drive with the spindle is disposed. The seat is attached at a projecting bar which is swivelled about the column. A hand crank is used for actuating the spindle. Meyer, Jr. does not provide for the convenience of tap water actuation and the lifting height to be reached with that disclosure is also not satisfactory.

There is accordingly a need for constructing such seats in such a way that they can be swiveled out of the bathtub as well, in order to make it easier to transfer to the bath seat.

However, it has proved to be practically impossible to construct such a hydraulic frame that is insertable into the bathtub, in such a way that the seat can also be swiveled out of the bathtub. That attempt has failed because overly strong tilting and shearing forces are exerted on the hydraulic cylinders as they swivel out of the bathtub, with the risk that the hydraulic cylinder and the frame itself, or the entire bathtub, will tip over, especially since bathtubs in private homes are sometimes not firmly anchored to the floor.

A bathing aid for such a purpose is already known from Published British Application No. 2,120,933, in which the hydraulic frame is secured to the head of the tub, behind the tub. With that frame, it is possible to raise and lower the seat out of and into the bathtub as well as to swivel it outward by 90°. However, then the seat can be lowered only as far as the edge of the tub. Additionally, that equipment requires considerable space and is very complicated in its layout and construction, so that it has not gained wide use in practice.

SUMMARY OF THE INVENTION

It is accordingly an object of the invention to provide a bathing aid, which overcomes the above-mentioned disadvantages of the heretofore-known devices of this general type, which is simple in structure, requires little space, and is constructed in such a way that such seats can easily be moved into and out of the tub in a simple way and moreover the seat can be swiveled out of the tub and can be lowered to the same level outside the tub as that to which the seat is lowered inside the tub. It is also an object of the invention to provide a bathing aid which requires very little space, yet reaches an extended height with the requisite spacing between the seat surface and the upper edge of the bathtub without sheared jamming of the telescope.

With the foregoing and other objects in view there is provided, in accordance with the invention, a bathing aid, comprising a column formed of at least three hydraulic cylinders to be telescopingly moved within one another and being actuatable solely by tap water pressure, the at least three hydraulic cylinders including a lowermost hydraulic cylinder fixedly mounted on a floor laterally next to a head of a bathtub, and an uppermost hydraulic cylinder with a head;

a crossbar being secured with low friction to the head of the uppermost hydraulic cylinder, being swivelable through at least 90° and having a free end;

a seat having a backrest being pivotably connected to the free end of the crossbar, for lowering and raising the seat telescopingly and swiveling the seat out of the bathtub; and wherein each of the hydraulic cylinders have diameters, and some of the hydraulic cylinders each project into a respective larger hydraulic cylinder with a guided fastening length being at least three times its diameter.

This makes it possible, even in private homes, to build-in a bathing aid that only requires little space and with which such a seat can also be swiveled out of the bathtub simply and can be lowered a long way, so as to enable easier transfer, for instance to a wheelchair, even without external assistance.

In other words, there is provided a bathing aid with a column which is formed by a lowermost, rigidly attached hydraulic cylinder and two telescopically shifted further hydraulic cylinders. The result is that none of the prior art bathing aids achieve anywhere the same ratio between retracted height and extended height. The extended height is important in the context of paralyzed persons, whose legs dangle from the seat, thus requiring a substantial distance between the seat surface and the upper edge of the bathtub. Furthermore, none of the references discloses the claimed structure which allows clamping-free extension of the hydraulic cylinders.

In accordance with another feature of the invention, in order to provide additional stabilization, the column of hydraulic cylinders is supported on the bathtub rim by a lateral arm secured to the lowermost, stationary hydraulic cylinder.

In accordance with a further feature of the invention, the head of the uppermost hydraulic cylinder has a total stroke height of at least 1000 mm. This is done in order to enable the seat to be swivelled inward even with a person seated on it and with the person's lower legs hanging downward.

In accordance with an added feature of the invention, in order to provide simple operation, manual valve actuation means for raising, lowering and swiveling the seat itself are provided on the seat.

In accordance with an additional feature of the invention, the pressure force of the hydraulic cylinders is approximately 150 kg.

In accordance with yet another feature of the invention, the crossbar is supported through ball bearings on the head of the uppermost hydraulic cylinder. This is done because hydraulic cylinders are practically incapable of being rotated in their guide, particularly under additional bending loads.

In accordance with yet a further feature of the invention, the crossbar is drivable for swivelling through the use of a water motor.

In accordance with yet an added feature of the invention, the water motor is built into the crossbar and acts upon a rack that is operatively connected to a gear ring surrounding the uppermost hydraulic cylinder.

In accordance with a concomitant feature of the invention, in order to prevent the crossbar from being swiveled too far, the gear ring is provided with stops for limiting the angle of rotation of the crossbar.

Other features which are considered as characteristic for the invention are set forth in the appended claims.

Although the invention is illustrated and described herein as embodied in a bathing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

DESCRIPTION OF THE PREFERRED EMBODIMENTS

Figure 1:
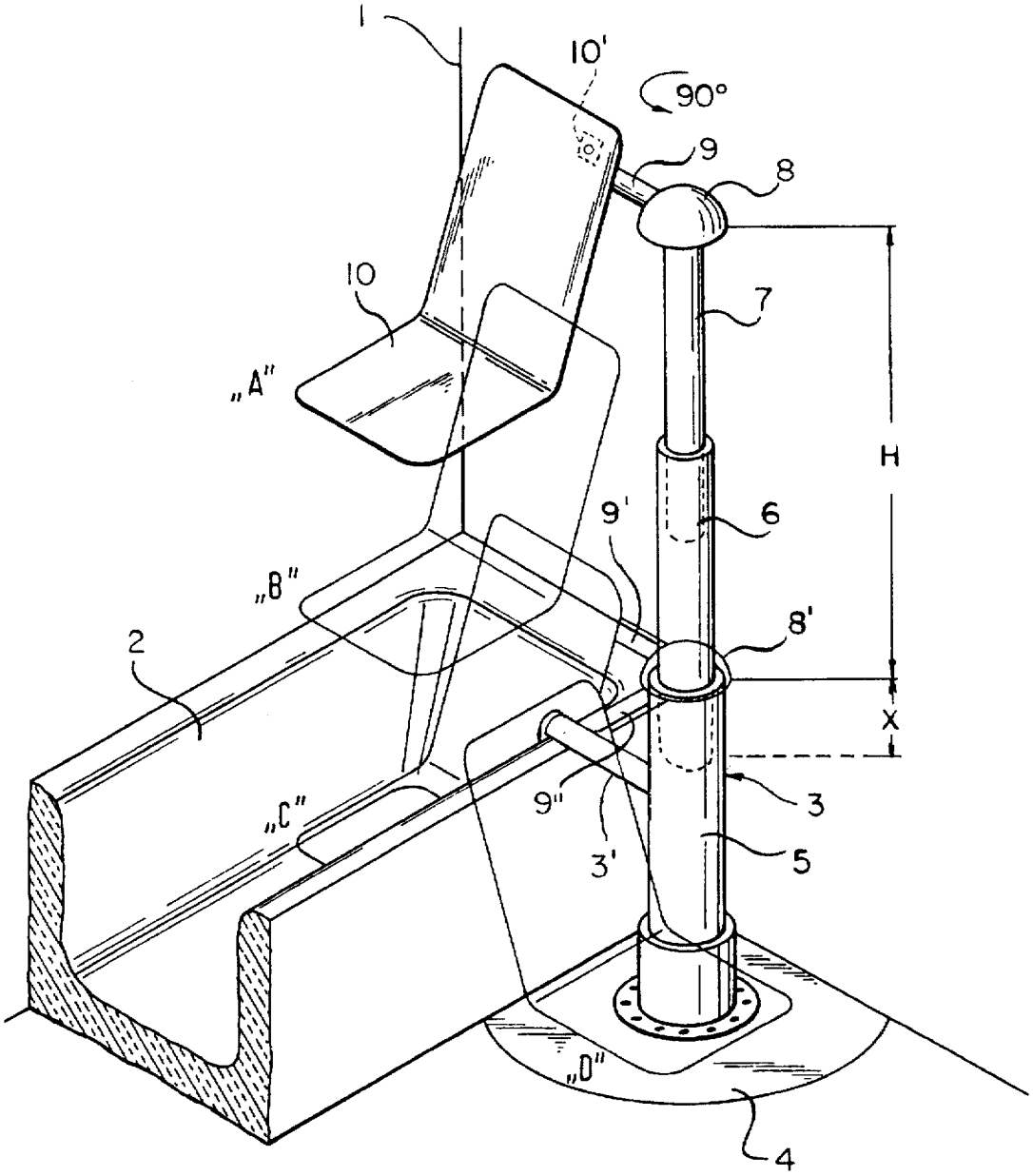
FIG. 1 is a fragmentary, diagrammatic, perspective view of the entire structure of a bathing aid according to the invention at different positions.

Referring now to the figures of the drawing in detail and first, particularly, to FIG. 1 thereof, there is seen a bathtub 2 which is installed, for instance, in a corner 1 of a bathroom. A column 3 of hydraulic cylinders 5, 6 and 7 is firmly anchored to the floor next to a head end of the bathtub, by a circular bottom plate 4. A lateral arm 3' secured to the lowermost cylinder 5 supports the column 3 on a rim of the bathtub 2.

In the illustrated exemplary embodiment, the column 3 includes a lower, stationary hydraulic cylinder 5 and two further hydraulic cylinders 6 and 7, with one being movable within the another. A horizontally protruding crossbar 9 is pivotably secured to the head of the uppermost hydraulic cylinder 7 through a low-friction bearing 8, which is not shown in detail. A bath seat 10 is suspended from a free end of the crossbar 9.

As is also seen from the drawing, this bath seat 10 can be lowered from its highest position A, through an intermediate position B, down as far as the bottom of the bathtub which corresponds to a position C. The crossbar 9 is shown in its lowermost position 9' and the low-friction bearing is shown in its lowermost position 8'.

It is possible to raise the seat from its position C to the uppermost position A in the same way. The seat 10 is then swiveled forward through 90° counterclockwise, by the crossbar 9 and the head 8, and is then lowered until it assumes its lowermost position D outside the tub. The position of the crossbar at that time is represented by reference numeral 9".

A total stroke H of the telescoping column 3 should be at least 1000 mm, on one hand in order to enable lowering of the seat 10 down to its lowermost position C or D, and moreover to enable the seat 10 to be raised far enough to its uppermost position A that the seat can be swiveled outward or inward even with a person being seated on it and having his or her legs hanging down. In addition, the pressure force of the hydraulic cylinders should be approximately 150 kg.

In order to enable easy swiveling of the crossbar 9 without additionally exerting pressure on the hydraulic cylinders 6 and 7, it is suitable if the crossbar 9 is propped and supported by its rotating head 8 in non-illustrated ball bearing rings on the hydraulic cylinder 7. Rotating the crossbar 9 is possible through the use of a water motor 11 which is built into the crossbar 9 and has a driven rack 12 that acts on a gear ring 13 on the hydraulic cylinder 7. The gear ring 13 has stops 14 in the rotating head 8 for limiting the angle of rotation of the crossbar 9. This is done in order to prevent swiveling over an excessively large swivel angle. The water motor 11 is supplied through a hose 15 to be connected to a water tap.

Water motors in general are well known in the art, as described, for instance, in U.S. Pat. No. 2,813,277 to Zillt (herein incorporated by reference).

Figure 2:
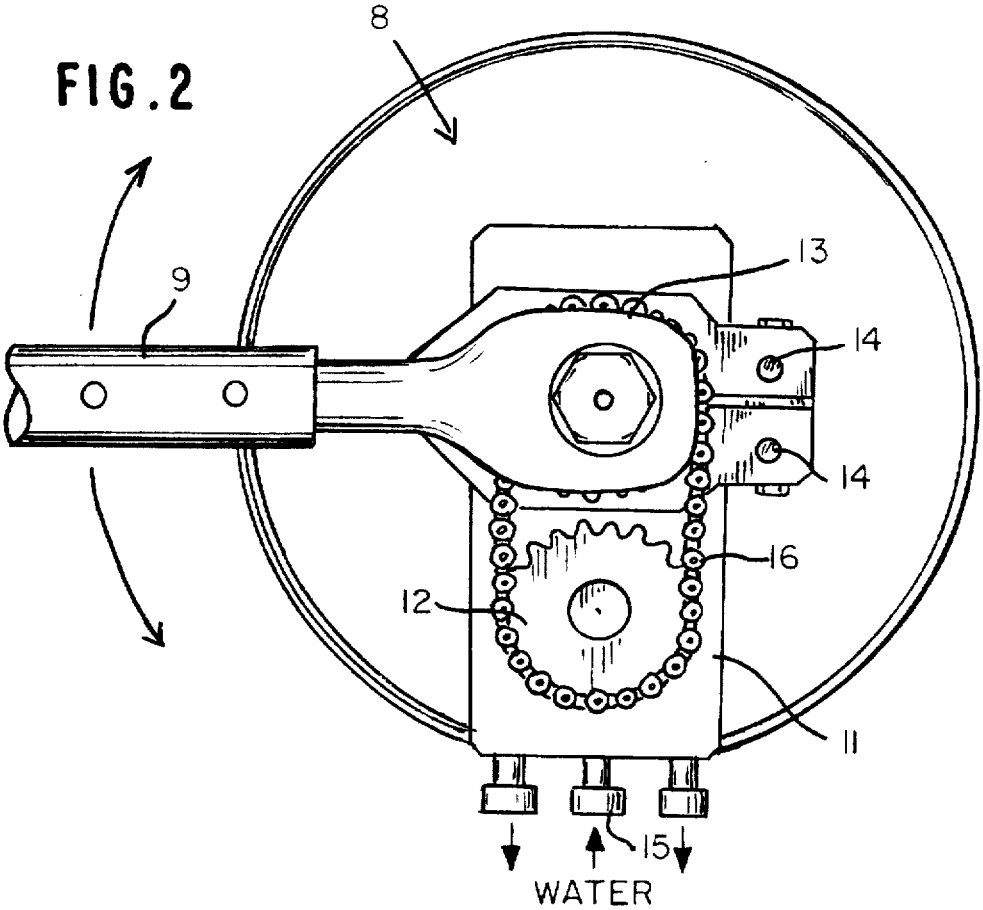
FIG. 2 is a diagrammatic top view of the head of the assembly with the swivel drive.

With reference to FIG. 2, the water motor 11 is driven by water entering the motor housing at the inlet 15. The sprocket 12 or driven rack 12 is connected to the gear on the gear ring 13 via an endless chain 16. The stops 14 limit the angular swivel of the crossbar 9. The stops 14 may, in addition, switch the water flow into the housing of the water motor 11 upon reaching their respective end points.

Figure 3:
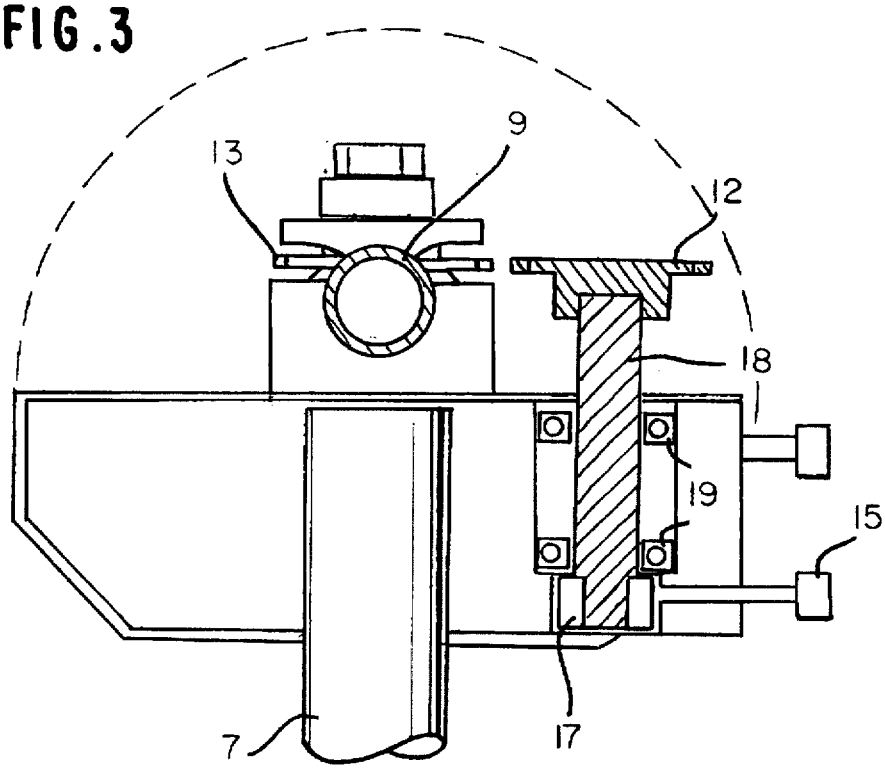
FIG. 3 is a partly sectional side elevational view thereof.

With reference to FIG. 3, the water entering at 15 impinges on a turbine 17 at a lower end of a water motor axle 18. The sprocket 12 is rigidly mounted at an upper end of the axle 18. Naturally, the sprocket 12 is at the same level as the gear of the gear ring 13. Also indicated in FIG. 3 is the crossbar 9 which points out of the drawing page towards the observer. The axle 18 of the water motor 11 is stabilized by ball bearings 19. Ball bearings or similar bearings at the gear ring 13 are not illustrated for clarity.

Figure 4:
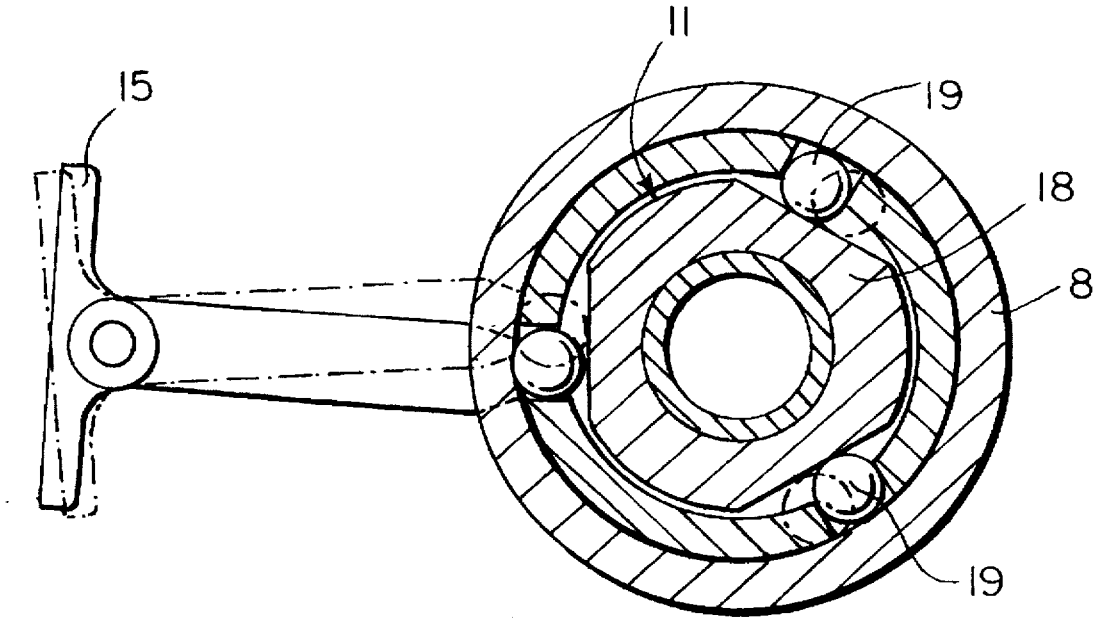
FIG. 4 is a diagrammatic top view illustrating the functional principle of the water motor rotation reversal.

With reference to FIG. 4, the rotational direction of the water motor 11 (i.e. the axle 18 and the sprocket 12) may be changed by changing the direction at which the water inlet is aimed towards the turbine. Direct radial impingement (towards the axis of rotation of the axle 18) neutralizes the motor. If the water inlet is directed slightly towards the right of the axis, a tangential force component towards the right results and the water motor is driven in that direction (counter-clockwise in FIG. 4). The direction may be reversed by directing the water inlet in the opposite direction. The principle diagram of FIG. 4 may be varied depending on the torque and angular speed requirements of the specific application.

In order to actuate the bathing aid, a manual actuation valve switch 10' is provided on a backrest of the seat 10. With this valve the seat 10 can be raised or lowered and can also be swiveled. In other words, the valve switch 10' allows actuation of the telescopic cylinder assembly for raising and lowering the seat 10 and also of the water motor 11 (in either rotational direction) for swiveling the crossbar 9 with the seat 10.

The overall result is accordingly a bathing aid that while requiring only very little space and being simple in construction makes it possible not only to move a seat into the bathtub and out again but also to swivel it out of the region of the bathtub, so that it is simple to use even without assistance by another person.

In summary, there is disclosed herein a bathing aid with a column having (at least) two telescopically shifted hydraulic cylinders 6 and 7 which are actuated solely with tap water pressure. The free end of the uppermost hydraulic cylinder 7 has a head 8 with a cross bar 9 which can be swiveled about the longitudinal axis of the column 3. The backrest of the seat 10 is attached at the swivelable cross bar. Furthermore, the fastening length of each hydraulic cylinder within the respectively larger hydraulic cylinder is at least three times that of its diameter. In other words, if a given cylinder has a diameter d, then that given cylinder dives into the respectively larger cylinder by a distance $x \geqq d/3$.

The foregoing construction leads to very substantial advantages. In its retracted position, the bathing aid is relatively small. However, it may be extracted and lifted to an extended height which allows a paralyzed person with dangling legs to be swiveled above the bathtub edge. At such extreme heights, the clamping torques (shearing stress) on the hydraulic cylinders are so severe that the system must be carefully protected against jamming. This is avoided by the at last three-fold fastening length as compared to the diameter. The seat of the claimed bathing aid can be lowered and lifted solely by tap water pressure. With the swivellable structure of the cross bar as disclosed and claimed, the patient may swivel above the upper edge of the bathtub by him or herself.

I claim:

1. A bathing aid, comprising:

a column formed of at least three hydraulic cylinders to be telescopingly moved within one another and being actuatable solely by tap water pressure, said at least three hydraulic cylinders including a lowermost hydraulic cylinder fixedly mounted on a floor laterally next to a head of a bathtub, an intermediate cylinder and an uppermost hydraulic cylinder with a head;

a crossbar being secured at one end with low friction to said head of said uppermost hydraulic cylinder, said crossbar being swivelable about a vertical axis through at least 90° and having a free end;

a seat having a backrest being pivotably connected to said free end of said crossbar, for lowering and raising said seat telescopingly and swiveling said seat out of the bathtub; and wherein each of said hydraulic cylinders has a given diameter, and a respective portion of said uppermost and intermediate hydraulic cylinders each projects into a respective larger hydraulic cylinder with a guided fastening length at three times a diameter of the cooperating smaller hydraulic cylinder respectively.

2. The bathing aid according to claim 1, wherein said column has a lateral arm secured to said lowermost stationary hydraulic cylinder for supporting said column on a rim of the bathtub.

3. The bathing aid according to claim 1, wherein said head of said uppermost hydraulic cylinder has a total stroke height of at least 1000 mm.

4. The bathing aid according to claim 1, including manual valve actuation means disposed on said seat for raising, lowering and swiveling said seat.

5. The bathing aid according to claim 1, wherein said hydraulic cylinders have a pressure force of approximately 150 kg.

6. The bathing aid according to claim 1, wherein said crossbar is supported by ball bearings on said head of said uppermost hydraulic cylinder.

7. The bathing aid according to claim 6, including a water motor for driving said crossbar to swivel.

8. The bathing aid according to claim 7, including a gear ring surrounding said uppermost hydraulic cylinder, and a rack operatively connected to said gear ring, said water motor being built into said crossbar and acting upon said rack.

9. The bathing aid according to claim 8, wherein said gear ring is formed with stops for limiting an angle of rotation of said crossbar.

* * * * *